United States Patent [19]

Soong

[11] Patent Number: 5,054,781

[45] Date of Patent: Oct. 8, 1991

[54] SPORTS EQUIPMENT WITH ENHANCED FLEXIBILITY

[76] Inventor: Tsai C. Soong, 1839 Jackson Rd., Penfield, N.Y. 14625

[21] Appl. No.: 521,415

[22] Filed: May 10, 1990

[51] Int. Cl.[5] ..... A63B 53/08; A63B 53/14; A63B 49/08; A63B 59/00

[52] U.S. Cl. ..... 273/80 B; 273/81 R; 273/73 J; 273/67 R

[58] Field of Search ..... 273/80 B, 80 A, 80 C, 273/81 D, 73 G, 73 J, 80 R, 81 R, 186 R, 186 A, 75, 67 R, 81 R–81.6, 77 R, 193 R, 194 R

[56] References Cited

U.S. PATENT DOCUMENTS

| | | | |
|---|---|---|---|
| 603,694 | 5/1898 | Kavanaugh | 273/80 R |
| 1,968,616 | 7/1934 | Oldham | 273/81 R |
| 3,318,602 | 5/1967 | Kunihisa | 273/81 R |
| 3,638,943 | 2/1972 | Snauwaert | 273/73 J |
| 4,090,711 | 5/1978 | Amato | 273/80 R |
| 4,252,319 | 2/1981 | Lorang | 273/186 A |
| 4,580,785 | 4/1986 | Toku | 273/186 A |
| 4,811,947 | 3/1989 | Takatsuka et al. | 273/73 G |
| 4,979,743 | 12/1990 | Sears | 273/81 R |

*Primary Examiner*—Edward M. Coven
*Assistant Examiner*—Steven B. Wong
*Attorney, Agent, or Firm*—Bernard A. Chiama

[57] ABSTRACT

A sports equipment is disclosed as having a handle, a head and a shaft connecting the head to the handle wherein the shaft has at its butt end of the handle a segment which is partially hollow and an insertion point. The equipment includes a central member partially disposed in the hollow segment through the insertion point. The central member is associated with the portion of the equipment positioned beyond the insertion point. A space is provided between the central member and the interior of the hollow portion of the segment to allow lateral movement of the central member relative to the shaft segment during bending of the shaft during impact with a game ball.

24 Claims, 8 Drawing Sheets

SPORTS EQUIPMENT WITH ENHANCED FLEXIBILITY

BACKGROUND OF THE INVENTION

The present invention is applied to sports equipment where a device consisting of a long shaft, having a handle at one end and a head at the other end, is used to strike a play object, such as a ball, to make the ball to fly away at a great speed. In later discussions, the golf club is taken as a sample to illustrate the invention, but the application is not limited to golf clubs.

In golf, the driver is used to drive a golf ball to a large distance away, several hundred yards. The golf club consists of a handle, a long and slender shaft and a head which is a solid mass made of wood, metal and other materials. The head is used to strike the ball at a high speed, to propel it forward and when the ball is no longer in contact with the head, it will fly away at a large velocity. The distance it can travel depends on its initial speed, and the initial angle of inclination of the ball's trajectory with respect to the ground.

The head of the driver, more than 210 gm in weight, is much heavier than the shaft itself, about 100 gm. Handle is a portion of the shaft, usually comprising a grip made of frictional material, such as rubber, for the hand to hold. The purpose of having a heavy head is to have a large inertia mass to force the ball, 42 gm., to move quickly with minimum slowing-down of the head.

DESCRIPTION OF THE PRIOR ART

The rule governing the construction of the shaft of the golf club is simple: that the axis should be straight, circular in cross section, and its bending and twisting property should be axi-symmetric, same in all directions. The state of art of the shaft of the golf club is thin-walled tubing, made of metal or fiber-reinforced plastics, its diameter is the largest near the handle and tapers down towards the head and is narrowest nearing the head before the large mass of the head is reached. The simplicity of the construction of the golf club shaft and its small diameter from end to end wherein not much in the way of extras can be installed inside the length of the shaft are main reasons that improvement of the shaft is difficult. Head construction and grip for better hold are areas of activities for people in the trade, but almost nothing in terms of patents about the shaft per se was found, except a U.S. Pat. No. 2,992,828 which is about a wire inside the shaft to compensate for the eccentricity of the head. The trend regarding to the improvement of the head velocity within the realm of the shaft is to use more sophisticated material, like fiber-reinforced composite material to construct a shaft which is light, yet is very strong, and flexible. More flexibility enables the shaft to be bent more severly and consequently the head travels more during the swing and can hit the golf ball at a greater velocity than a less flexible shaft. However, a shaft which is too flexible, especially when most of the bending in the shaft is done near the lower portion of the shaft which is closer to the head than the length closer to the handle. Such a club would be too easy to flutter, difficult to control the swing and would be difficult to drive the head to hit the ball accurately at the exact center. This is a basic problem of prior art with respect to the shaft of the golf club.

SUMMARY OF THE INVENTION

Through analysis of the mechanics of driving a golf ball by a golf club, it is found that the flexibility of the shaft of the club is crucial to the velocity of the head. The flexibility enables the shaft of the golf club to store bending strain energy in the shaft at the initial phase of the trajectory of the club during its downward swing, then at the later part of the trajectory, the bended shaft begins to straighten up which brings the head to move faster. In terms of energy conservation, its bending strain energy is added to the kinetic energy. When all the bending strain energy of the shaft is transformed into kinetic energy, the shaft becomes completely straight again and the velocity of the head reaches the maximum. This will be shown later in FIG. 10A, obtained through a rigorous computer analysis. There is a natural frequency of the shaft associated with the back-and-forth movement of the head mass. At the instant of hitting the ball, the head mass should be managed to be at its maximum speed. The invention seeks a way to influence the forced vibration of the system, store more bending strain energy in the drive at the initial phase of the motion when the initial impulse is great, and thereby increases the kinetic energy available to the moving head in the later phase of the motion. Such devices will be described after the mechanics of ball/club interaction is discussed.

BRIEF DESCRIPTION OF THE DRAWINGS

For the purpose of illustrating the invention, there is shown in the drawings forms which are presently prefered, it being understood, however, that this invention is not limited to the precise arrangements and geometries shown.

DESCRIPTION OF THE PREFERRED INVENTION

The invention is not possible without an analysis to study how the golf club is swung, bent and hitting the stationary ball. A golf ball is designed to absorb the impact from the club head and store compressive strain energy. It deforms and compresion is developed. The compressive force in the deformed ball will accelerate the ball. As the ball is recovering from the compression, the ball will be accelerated even faster than the head. Finally, the compression is completely transformed into kinetic energy and the ball is no longer deformed. After that, there is no contact force transmitted, the ball flies away at a much larger velocity than the velocity of the head at that moment. Since the ball is initially at rest and is being hit suddenly by the speeding club head, it will be very quickly compressed solid and in a very short time propelled to move at the same speed as the club head. Here we assume that the head is so heavy that the increased momentum of the ball is not slowing down the head. The total contact time is less than two thousandth of a second, but the impact energy stored is so great that when it is all transformed into kinetic energy, the ball would reach a much higher speed than the speed of the club head. It can be proved by analysis that the ball flies away at twice the speed of the club. This phenomenon is important to the understanding of the strain energy built-up in the shaft that supplies the large head speed to drive the ball.

Figure 1:
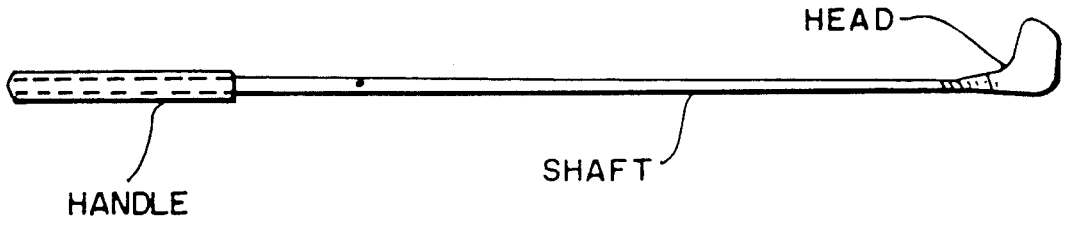
FIG. 1 shows a conventional golf club.

FIG. 1 shows the geometry of a conventional golf club. For a gold club, the shaft extends into the rubber grip and is attached to the head at the other end For other sports equipment, the handle could be a distinct piece separate from the structural entity of the equipment. A preferred understanding is that handle is where the hand is used to hold and it may be a part of the shaft structure. Even though we may describe a sports equipment as is composed of a handle, a shaft and a head, there should be no absolute dividing point to distinguish the handle and the shaft.

Figure 2A:
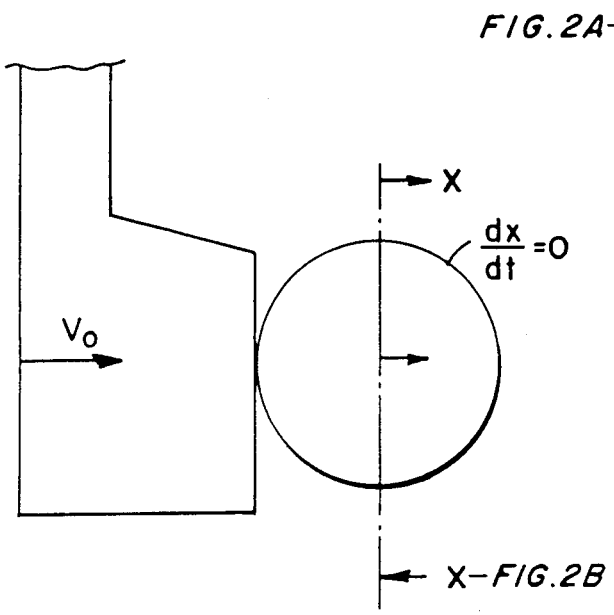
FIG. 2(A) shows the head of a golf club hits a stationary ball, (B), Ball and head travel together for a distance X.
Figure 2B:
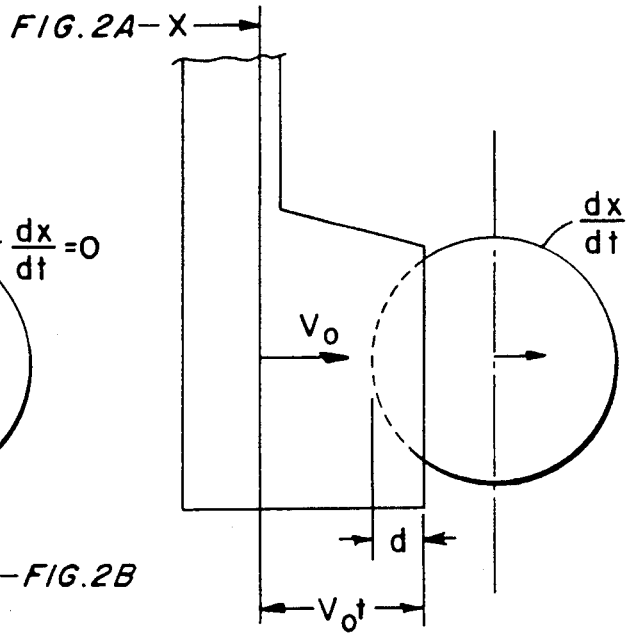

FIG. 2A shows that the club head is moving at a constant speed $V_o$, striking the stationary ball at time $t=0$. FIG. 2B shows the situation at a later time t when the head had moved a distance $V_o t$, the ball has been pushed to a distance X and its velocity is at dX/dt. The indentation of the ball, d, is $$d = V_o t - X \tag{1}$$

Figure 3:
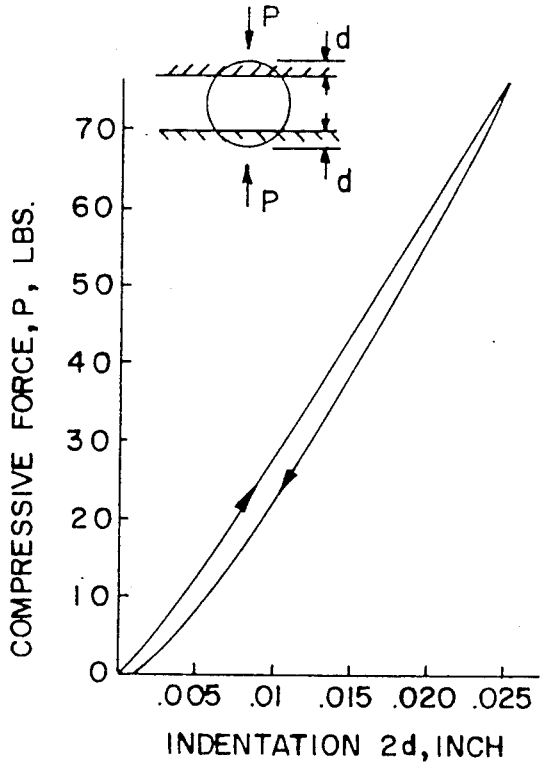
FIG. 3 shows test result of the force and indentation curve of the golf ball.

To derive the force required to indent the ball, we need a laboratory test of a golf ball under compressive force. Such a data has been accurately obtained from a laboratory test. FIG. 3 shows the measured compressive force P on a golf ball at different amount of indentation d. The upper curve is the loading curve and the lower one is the unloading curve. The average slope P/d, denoted by s, is s=slope=285 kg/cm. Based on this test result, the force F and indentation d at any time can be expressed by the following linear relationship, $$F = s \times d \tag{2}$$

Newton's law $F=s\times d$ yields the differential equation of motion of the ball driven by the club head:

$$(W/g)(d^2X/dt^2) = (V_o t - X)s \tag{3}$$

where the ball's weight W is 42 gm. and g=gravity constant=980 cm/sec.$^2$.

The solution of Eq.(3) which satisfies the initial conditions of zero indentation and zero ball speed at time $t=0$, is $$X = V_o(t - \sin((sg/W)^{\frac{1}{2}}t)/(sg/W)^{-\frac{1}{2}})) \tag{4}$$

and the corresponding velocity and acceleration equations are $$dX/dt = V_o(1 - \cos((sg/W)^{\frac{1}{2}}t)) \tag{5}$$

$$d^2X/dt^2 = V_o(sg/W)^{\frac{1}{2}} \cdot \sin((sg/W)^{\frac{1}{2}}t)) \tag{6}$$

The total contact time t* and the flyoff speed V* can be calculated as follows. In Eq.(6), the acceleration will become zero when the factor $\sin((gt/W)^{\frac{1}{2}}t)$ vanishes. If at $t=t^*$ thjs.term vanishes, then $$t^* = \text{contact time} = 3.1416/(285{,}000 \cdot 980/42)^{\frac{1}{2}} = 0.0012 \text{ sec.} \tag{7}$$

this is a very short impact time. During the entire period of contact, the travel of the ball from its stationary position to the fly-off point is, say X*, is obtained by Eq.(4), $$X^* = \text{contact distance} = V_o t^* = 0.0012\ V_o \text{ cm.} \tag{8}$$

The speed of the ball at the separation time t* is, from Eq.(5), $$V^* = dX/dt = V_o(1 - \cos((sg/W)^{\frac{1}{2}}t^*) = 2V_o \tag{9}$$

This equation shows the ball's speed is twice the speed of the club head. This is important to know with regard to what is the velocity of the head required to send the ball to a desired distance.

If the inclination angle of the trajectory is 45-dgrees, the horizontal distance the ball can travel is $$L_{max} = \text{travel distance} = V^{*2}/g = 4V_o^2/g \tag{10}$$

To have a realistic understanding of the magnitude of these quantities, let us take a golf player who hits the ball to a distance of 275 yard (275 m), i.e., $L_{max}$ in Eqs.(10) is 275 m. According to Eq.(10), the speed of the head, $V_o$, should be $$V_o = \text{initial velocity} = (27{,}500 \times 980/4)^{\frac{1}{2}} = 2{,}590 \text{ cm/sec.} \tag{11}$$

With the club hitting the stationary ball at a speed of 25.9 m/sec., maintaining contact for only 0.0012 second, the club head and the ball will travel together only for a very short distance given by (Eq.8):

$$X^* = \text{contact distance} = 0.0012 \times 2{,}590 = 3 \text{ centimeter.} \tag{12}$$

The required head velocity, duration of contact with the ball and distance they travelled together are important design information and is important to the invention. It is clear that the head of the club should be heavy so that the momentum imparted to the ball will not slow down the head. The velocity of the head at the time of impact is also important. At a speed of 26 meters per second or more, It is difficult for a straight shaft of a length 100 centimeters to reach that terminal speed just by driving it hard. Here is the opportiunity of taking advantage of the vibration of the shaft. An optimally flexible shaft with the head speed enhanced by the natural frequency of the shaft, transforming the bending energy to the kinetic energy, yet is still rigid enough to propel the drive, the club head could reach the maximum speed and hit the ball just in time. This is what the invention is aimed at.

The present invention devises a way to increase the bending strain energy of the shaft with very little change in the conventional geometry of the club, including shaft size, length, grip, and etc. The invention proposes that extra length of tubes be disposed inside the original shaft such that at a point along its length, called an insertion point, preferably close to or inside the handle portion of the shaft, the shaft is coupled to a smaller tube, called intermediate tube, which is disposed inside the original shaft. This smaller tube extends backward for some length and is then coupled to an even smaller tube, called central member, disposed inside the intermediate tube, which reverses the direction and extends forward again, surpassing the original shaft at the insertion point and extends beyond. The intermediate tube, or similar tubes between the original shaft and the central member, the central member, and the necessary means for coupling, constitute an assembly. What continues beyond is not taken as a part of this assembly. The central member, beyond the surpassing point, is coupled to the downstream length of the original shaft or yet to another assembly. Details may vary, connection locations and means may vary, tubes may be partially hollow or partially disposed in relations to each other, all being understood and allowed for.

Detail of the invention, described with the golf club as an example, but is not limited to the given geometry, is given below.

Figure 4:
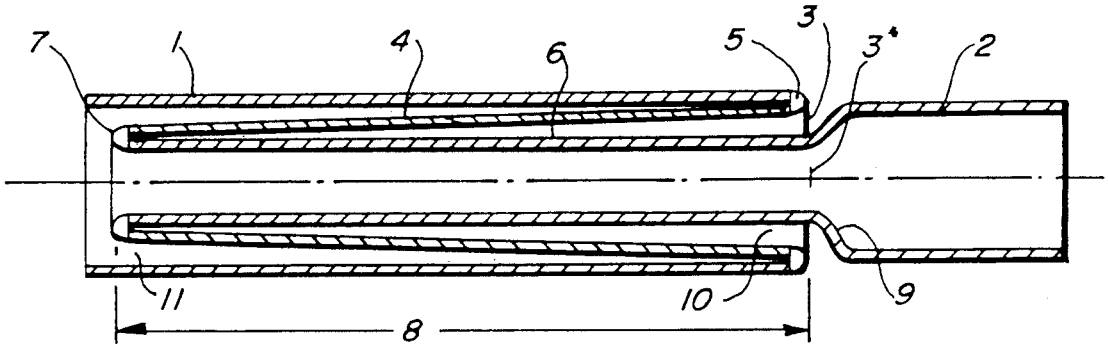
FIG. 4 shows a preferred configuration of the assembly.

FIG. 4 shows a preferred embodiment of the assembly. The shaft up to the insertion point 3 from the left is the upstream original shaft; the portion of that shaft which contains a unit assembly is called a shaft segment, or segment 1; segment 2 on the right is the downstream portion of the original shaft; it is not a part of the current shaft segment. Segments 1 and 2 are not necessary of the same size at the insertion point 3. Either segment may be towards the handle of the shaft. Instead of joining with segment 2, however, the segment 1 is now structurally coupled to an intermediate tube 4 of the assembly through a coupling means 5, near the insertion point 3 The coupling means 5, and others like 7 and 9 later, may be a bracket, a weld, industrial glue, any other mechanical connecting means, or simply a molded integral joint as is shown in FIG. 4. Coupling 5 may be made close to 3 or at a distance from 3. The intermediate tube 4 is smaller in size than segment 1. Extending backward from point 3 for some length, 4 is coupled to the butt end 7 of a central member 6 of the assembly which may be a solid bar, a partially or completely hollow tube. After joining with 4 at 7, the central member 6 extends forward again towards the insertion point 3, and after overtaking a surpassing point 3*, which is understood as approximately the intersection point between the vertical line passing through 3 and crosses with the axis of 6, it joins with another assembly or with segment 2 by a coupling means. The coupling means may be a bracket, a weld, etc. or a molded neck 9 shown in FIG. 4. If the size of 6 is the same as the segment 2, the neck 9 may be a portion of the segment 2. We shall call all such arrangements after 3* but before the segment 2 as an association means. In later discussions about merits of the assembly, we take point 3 as the end of segment 1 and point 3* as the beginning of segment 2. In between the two points is the current assembly disposed inside the hollow of segment 1. If there is no asseembly, 3 is 3*. If there is an assembly, the angle of inclination of the club shaft at point 3* will be abruptly increased as compared with the angle of inclination at point 3 when the inertia force is applied at the head of the club. So after this additional bending inclination at point 3* reaches the head, the head will be bent backward more, and more strain energy is added to the shaft, and the maximum head speed will be much larger than the shaft without the assembly. This will be shown later in FIG. 10A and 11.

The length, 8, of the central member 6, and of the tube 4, from point 3, or 3*, to the butt end 7 is important to the flexibility of the assembly. It is the approximate length of the assembly. The longer they are, the angle of inclination at point 3* of the segment 2 relative to that of the segment 1 at point 3 will be larger. Since the bending moment of the inertia force at the head during swinging of the club is transmitted from segment 2 to member 6, then to tube 4, then to the segment 1, each tube will have different lateral movement and curvature change along its length relative to its neighboring tubes, spaces between 6 and 4 and between 4 to 1 should be provided along the whole length; and in particular, at locations 10 and 11 where the relative movement is the largest. Cushion material may be used in said spaces between neighboring tubes, selectively or completely. It is noted that if neighboring tubes do contact with each other during excessive swinging of the club, there would be no harm except further additional rotation of the tubes will be curtailed until the neighboring tubes separate, and the assembly becomes flexible again. Of course, when dimension 8 is too long, the required clearance at 10 and 11 will be more, which puts a practical limit to the lengths of 4 and 6.

In FIG. 4 there is only one intermediate tube 4 shown in the assembly. There could be more than one. Take three as example, First intermediate tube 4 is the largest within the segment 1. A smaller, second intermediate tube connects the first intermediate tube at the first butt end 7, and extends towards point 3. The third intermediate tube, smaller than the second, connects the second intermediate tube at the second coupling 5 near 3; extends back towards the last butt end 7 to connect the central member 6, which is even smaller. Spaces should be provided among all tubes. The three intermediate tube assembly is completed.

Between the central member 6 and segment 2 downstream, there is offered at least two preferred ways to connect a second assembly to the first assembly. In the following description, the butt end 7 is designated as tail and the insertion point 3 as the head of an assembly. Assume the first assembly is nearer to the handle. If the central member 6 of the first assembly is connected to the corresponding segment 1 of the second assembly, it is a head-to-tail connection. If it is connected to the central member of the second assembly, it is a head-to-tail connection. Both are feasible and preferred. The increment of the angle of inclination at point 3* of the second assembly as compared with the angle at point 3 of the first assmebly will be same for both ways of connection. However, since a central member 6 is smaller in size than its segment 1, head-to-head connection is a more preferred way to connect two assemblies in series because it leaves the larger end, segment 1, of the second assembly to face the downstream portion of the shaft. Connection will be easier. Such a more preferred arrangement is shown later in FIG. 12. Of course, distance between consecutive assemblies may be arbitrary. Assemblies placed closer to the handle will have more benefit than placed nearer the head because the incremental throw-back distance of the head is equal to the incremental inclination angle at 3* multiplied by the distance from the head to the insertion point.

Figure 5:
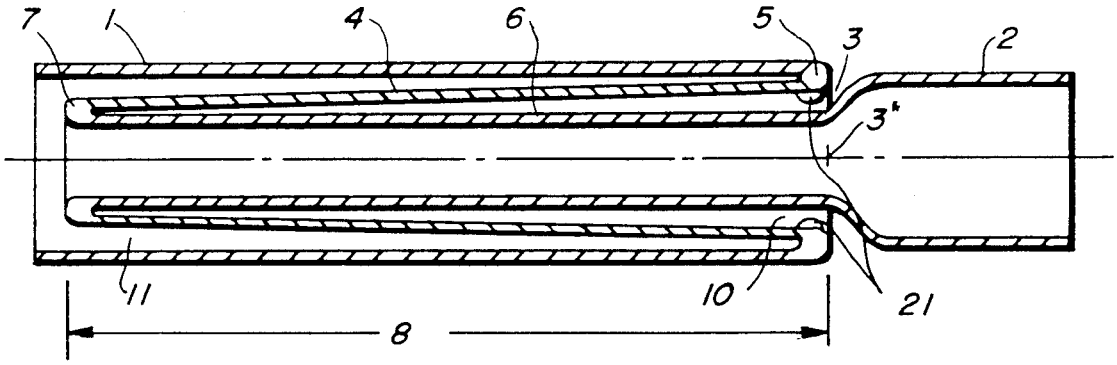
FIG. 5 shows a preferred assembly with a pivot device.

Another embodiment is shown in FIG. 5 where a pivot device 21 close to the insertion point 3 is made as an integral part of segment 1. This pivot device limits the lateral movement of 6 relative to the wall of segment 1 at that point, but inclination of member 6 with 21 as pivot is still unrestricted. Limiting the laterlal movement of 6 at the entrance at the segment 1 adds firmness for the hand to control the swing. The pivot device 21 may be a ring of the same material as segment 1 with rounded edges to permit rotation of 6 about an axis perpendicular to the axis of the segment 1. Other ways are also feasible. The device may also include a layer of hard rubber, similar cushion material or even a small space, between 6 and the unyielding part of the pivot. About the insertion point 3, between the current shafts and the adjacent segment or between the current segment and the downstream shaft connected to the central member 6, there may be an insertion material or devices disposed in the gap made by the two adjacdent shaft components as shown as 21 later in FIG. 12. It may be a pad, a rubber cushion or other material or devices.

In the design with a pivot device like 21 in FIG. 5, rotation angle of member 6 at point 3* can not be as large as the design in FIG. 4 with no pivot device. But the invention design, even with the pivot device at 21, will have at least 40% larger angle of inclination at point 3* than that of the segment 1 at the insertion point 3, owing to the additional bending from tubes 6 and 4 inside. For golf clubs, the advantages of having the assembly will not be fully utilized if the length of the assembly is less than 5 cm. which will be shown later. Prefered number of intermediate tubes in an assembly is at least one. Its length and location of couplings with 1 and 6 may be varied. Location of couplings along 6 may also be varied. A preferred number of assemblies in the handle is about 2 to 3, which depends on how long is the handle. If it is long, the number may be more. The rubber grip is preferred to be long enough to cover the exposed insertion point 3 to the last assembly employed in the handle.

Figure 6:
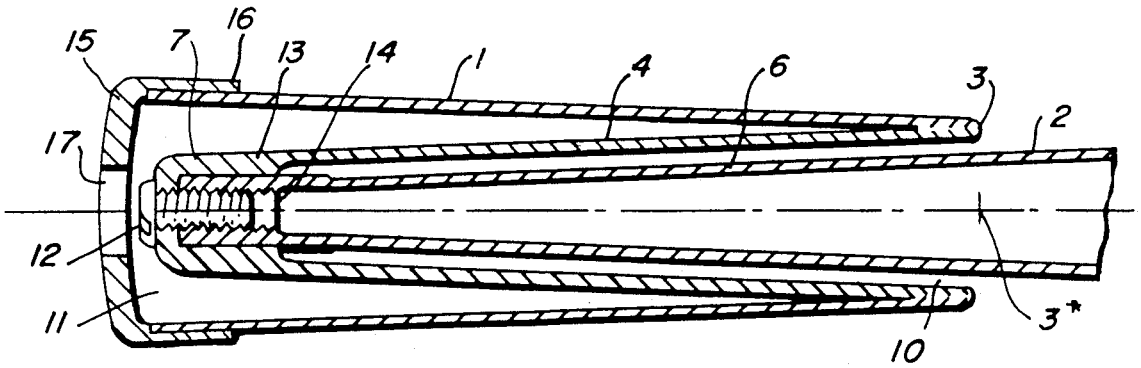
FIG. 6 shows a coupling of the central member to the intermediate tube.

Another embodiment is shown in FIG. 6 where a screw 12 is usd to secure the intermediate tube 4 to the central member 6 at their butt end 7 in which the end of 6 enters a tightly fitting housing 13 belonging to 4. The end of 6 at the butt point 7 is having a thicker end 14 with threads to receive the screw 12. Some degree of taperness is prefered at the contact between 4 and 6 at the housing 13 to facilitate the fastening. The cap 15 of the rubber grip 16 could have an opening 17 for access to the screw. In this manner, segment 1 which contains an assembly with tube 4 could become a detachable handle to receive segment 2, which is the downstream portion of the club. Segment 2 may be the same size as member 6 or larger. In the drawing it is shown as an extension of the member 6. FIG. 6 shows only one way to secure the assembly with the handle to the downstream portion of the shaft,; other means are available.

Figure 7A:
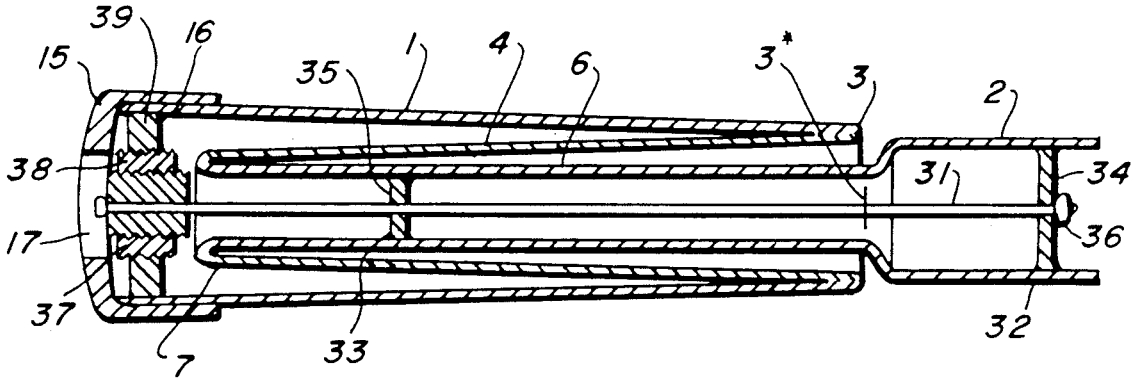
FIG. 7A, B show an embodiment of the assembly which contains a pretensioned wire.

Another embodiment is shown in FIG. 7A wherein a strong thin wire 31, such as made of steel or synthetic fiber material, is used to tie between two end points along the center line of the shaft such as in location 32 which is in segment 2 and in location 33 which is near the end 7 of tube 6. Wire supporting seats 34 and 35, with holes to pass the wire as shown, are fixed in 2 and 6 respectively. The distances along their respective lengths are optional. One end of the wire 36 is anchored at 34. The other end is anchored at a movable seat device which is cleared with the end 7. The seat device consists of an inner seat 37 which anchors the wire, an intermediate screw 38 and an outer screw 39 which is fixed about the end of segment 1. When screw 38 is turned, the inner seat 37 can be made to advance towards either direction along its axis. In this way, the wire can be tightened to the desired tension. Access hole 16 is provided in the cap so that the wire 31 can be tightened with the grip on. The hole in support 35 should be made snug with respect to the wire. When the segment 2 is bent under the inertia load, 6 will be displaced laterally with respect to the wall of the segment 1. The supporting seat 35 will press against the tightened wire which is anchored at the inner seat 37. Consequently, the lateral movement of the butt end 7 of member 6 with respect to segment 1 will be restrained by the tensioned wire. This will further aid the bending of the central member 6. Of course, other types of mechanical means can be used to adjust the tension of the wire. The device suggested in components 37, 38 and 39 is just one of possible means.

Figure 7B:
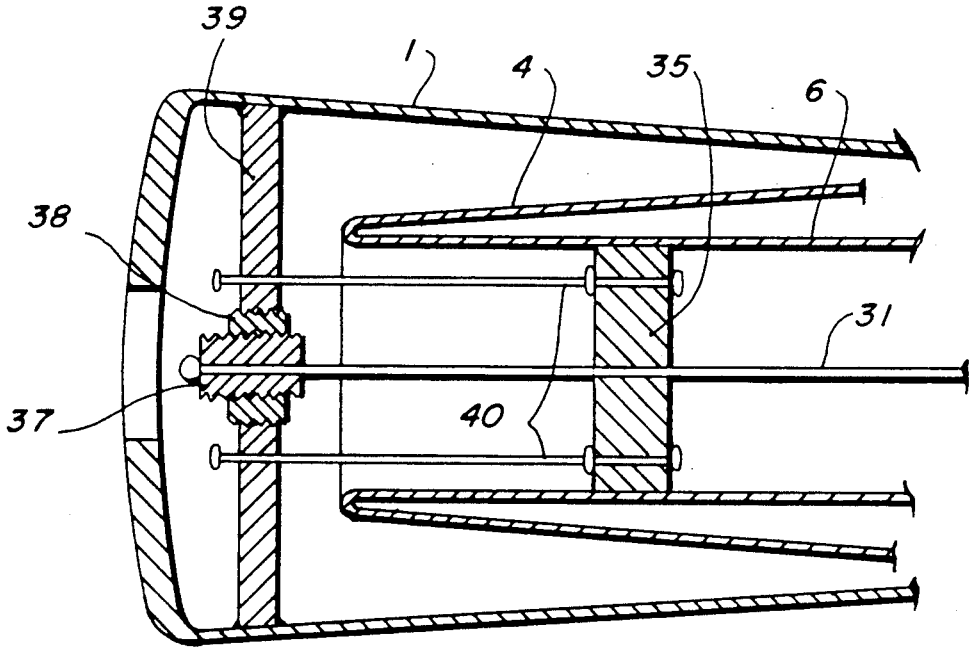

Furthermore, the locations 32 and 33 will affect the effectiveness of the device. Moving the seat 35 closer to the anchor 39, or making the wire 31 tighter, will make the tube 6 requiring more bending moment from segment 2 to rotate the same angle, which would make the head to store more energy with less travel. In other words, it makes the club stiffer, but still enhances its speed. Also, location of seats 32 and 33 along their axis may be adjusted to suit different players. For example, one way is to let 6 having screw thread along a partial length of its axis. Then seat 35 can be moved along the axis by turning the screw. The adjustment may be achieved before the longitudinal member 6 is joined to 4. Another way as shown in FIG. 7B is to have small rods 40 attached to 35 and connected to 39. Since 35 and 39 do not rotate, the position of 35 along the axis may be adjusted by push and pull of the rods, which is independent to the tensioning device. When the rods are fastened with the seat 39, support 35 will not move. Other adjustable devices are possible, FIG. 7B shows only one method.

Another embodiment to control the lateral movement of the butt end 7 of the longitudinal member 6 is to have the seat 37 to extend into the hole of the butt end 7. When the lateral movement of 7 exceeds the expected maximum amount, it touches 37 and further lateral movement of end 7 is is being curtailed.

Finally, as mentioned before, the discussions take the golf club as an example for easy understanding. However, the geometry described in the invention is equally applicable to other sports equipment having long stems, which may be non-circular, and internal components like 4 and 6 do not have to be completely enclosed inside the host segments 1. In the specification, the word hollow is preferred to mean to have an empty space to admit smaller size members, like 4 inside 1, but 4 does not have to be completely enclosed by 1 on all sides. In that way, the word diameter is preferred to be interchangeable with the word size, and the word inside by the word within.

In the following, we show how the assembly increases the drive range of the golf club. In the derivation, the pre-tensioned wire shown in FIG. 7A is omitted.

Figure 8A:
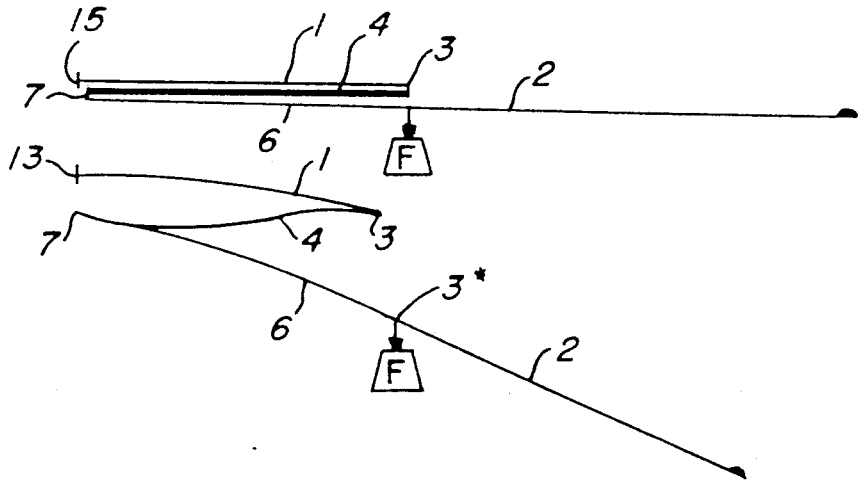
FIG. 8A, B show bending of a conventional club and a club with the assembly installed.
Figure 8B:
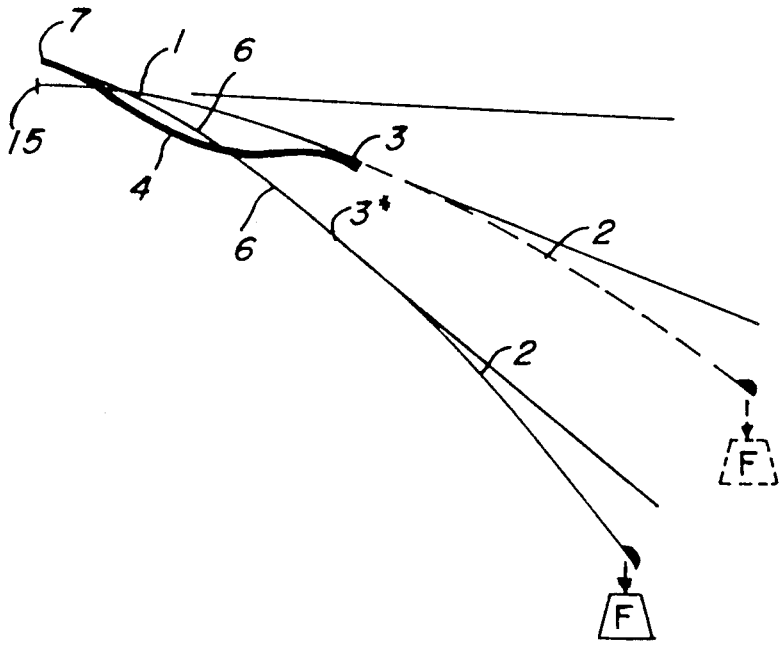

FIGS. 8A and 8B show the center lines of the three tubes 1, 4 and 6, of FIG. 4. The bending of the shaft caused by the inertia force F at the head is very much exagerated for clarity. All lateral movements of the assembly should be contained within the hollow of the segment 1. If the inertia force F is applied at the insertion point 3, the bending curve will look like FIG. 8A where the butt end 7 is dropped below the end point 15 of the handle. If F is at the head as shown in FIG. 8B, point 7 will be deflected above point 15 due to the large bending moment about point 3* from the load, which bends member 6 upward like a pole vault under bending using point 3* as a pivot. All these are derived from analysis. The three tubes 1, 4, and 6 in FIG. 8A are like three bellows of an accordion. The coupling points of the bellows of the accordian such as 3 and 7, move laterally and also rotate along the direction of bending. It is the rotation that really has significant effect on the travel of the head of the club because of the long arm between the head and the fulcrum pint 3*. If there is no assembly inserted, the angle of inclination of 7 would be zero; and the deflection of the shaft would be shown by the dotted line in FIG. 8B. That the solid deflection line in FIG. 8B can have a much larger magnitude is due primary to the added inclination angle at point 3* which is about three times the angle of inclination of the same point 3 of segment 1 in the dotted line.

Figure 9:
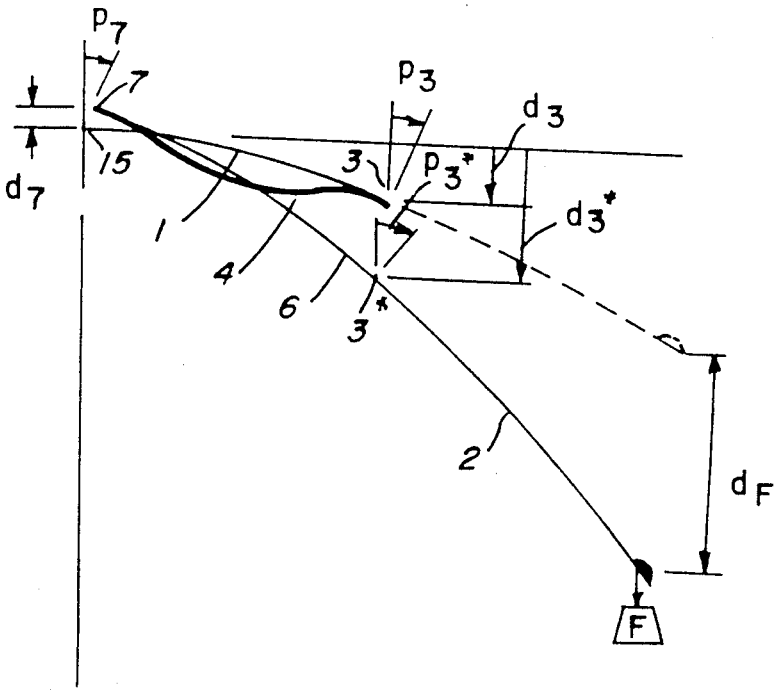
FIG. 9 shows lateral displacement and angle of inclination at locations 3, 7 and 3*  of the shaft with the assembly.

FIG. 9 is taken from FIG. 8B. A deflection analysis has performed on the shaft in FIG. 8B with a force F applied at the head. The bending stiffness of the segment 1, tubes 4 and 6 are all having the same bending stiffness value D, where $D=E\times(d_o^4-d_i^4)/64$, where E is the shaft's Young's modulus, which for steel, is $E=2.113\times 106$. Kg/cm$^2$. At the handle of the shaft in FIG. 1, shaft outside diameter $d_o$ is 1.5 cm and inside diameter $d_i$ is 1.43 cm. which yields the stiffness $D=91{,}367$ Kg-cm$^2$. Analysis shows the following deflections (labelled as d) and the angle of inclinations (labeled as p) at the insertion point 3 ($d_3$, $p_3$) of the segment 1, the butt end 7 of the longitudinal member 6 ($d_7$, $p_7$) and that of the segment 2 at the surpassing point 3* ($d_3$*, $p_3$*) are shown in Table 1:

TABLE 1

| (FIG. 9) | |
|---|---|
| $d_3$, downward, $= (Fb^3/D)(0.5N-0.17)$, | $p_3 = (Fb^2/D)(N+0.5)$ |
| $d_7$, upward, $= -1.0(Fb^3/D)(N-1.66)$, | $p_7 = 2\times p_3$ |
| $d_3$*, downward, $= 3\times d_3$, | $p_3$* $= 3\times p_3$ |

where b is the length of the central member 6 (8 in FIG. 4), and N is the length of the remaining shaft from 3* to the head divided by the length b. The distance $d_F$ in FIG. 9 is the additional displacement of the head due to the slope increase at point 3*. $d_F$=Nb. Table 1 and $d_F$ will be used later in a discussion using Table 2.

From Table 1, we see that the additional angular rotation at the same location point 3, because of having the assemby, is two times more for the shaft with the assembly. This additional angular rotation at the insertion point 3 will produce considerably more work done by the inertia force at the head which will be transformed later for additional velocity to the head. Example of merit will be given later.

The following discussion relates to results derived from a computer program dynamic drive.

The conventional, tapered golf club as shown in FIG. 1 has a constant wall thickness of t=0.036 cm, and a variable outside diameter given by the equation:

$$d_o(X)=0.8+0.00714\times \text{cm}.$$

where X is the distance measured from the end near the head.

Its bending stiffness D is a function of X too, given by $$D(X)=\text{bending rigidity}=(3.1416/8)\cdot E\cdot t(0.8-0.00714X)^3$$

where $E=2.113\times 10^6$ kg/cm$^2$ and t=0.036 cm.

A very complicated large rotation dynamic analysis, a state of the art in dynamics of elastic beam, is completed to study the given golf club in its swinging action from an overhead position until the head reaches the ground level. Taperness of the shaft, its variable mass distribution, and the eccentricity of the head relative to the club shaft, are all taken into account in the analysis. In one version, the club has the geometry exactly as is shown in FIG. 1. In another version, the assembly of a length b=10 cm, with bending rigidity D the same as the butt end of the shaft, is incorporated into the handle.

Figure 10A:
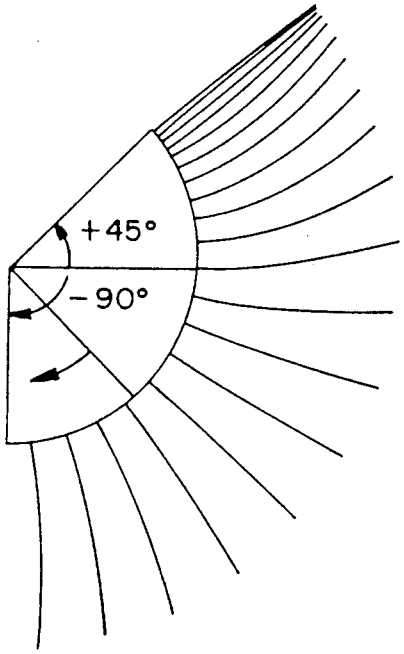
FIG. 10A, B show the computer program results of clubs in their trajectory.
Figure 10B:
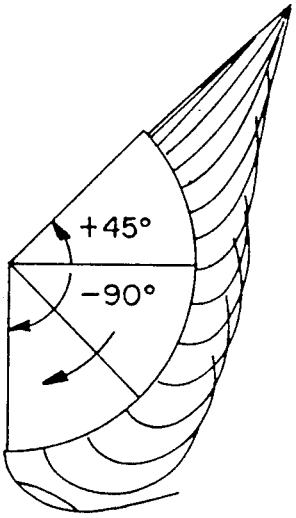

FIG. 10A shows the true bent shapes of the FIG. 1 club, without the assembly, at different positions of trajectory. The top deflection curve of the club was straight, then it bent backward as it was being swung downward due to the inertia force at the head. Then it began to straighten up. The maximum speed of 2600 cm/sec. is reached at the −30 degree position, after 0.23 seconds; the inertia force at the head at that instant is the maximum: F=5.7 kg. It should be noted that the head is bent the most backward at 23 degree position with head deflected back of 35.0 cm; and the head speed is only 1,187 cm/sec. But afterwards the head is racing forward by the periodic motion of the shaft and the bending energy is completely turned to kinetic energy at the time when the shaft is becoming straight with head speed becoming 2,600 cm/sec. That the flexibility of the shaft really helps to achieve higher head speed is very clear. However, if the shaft is too flexible, it will not recover in time. The period of vibration of the shaft is too large. This is shown in FIG. 10B. FIG. 10B shows the deflected shape of the club in its trajectory where the tapered shaft of FIG. 1 is replaced by an elastic, straight rod of 5 mm constant diameter with the same weight. Its bending stiffness is greatly reduced. It shows the shaft is too soft: the handle has completed its travel along the trajectory whereas the head is still way behind, thrown back by the inertia force from the acceleration. FIG. 10A and B demonstrated that the flexibility of a golf club has to be optimally designed and a golfer's timing and coordination are equally important to a successful drive.

Figure 11:
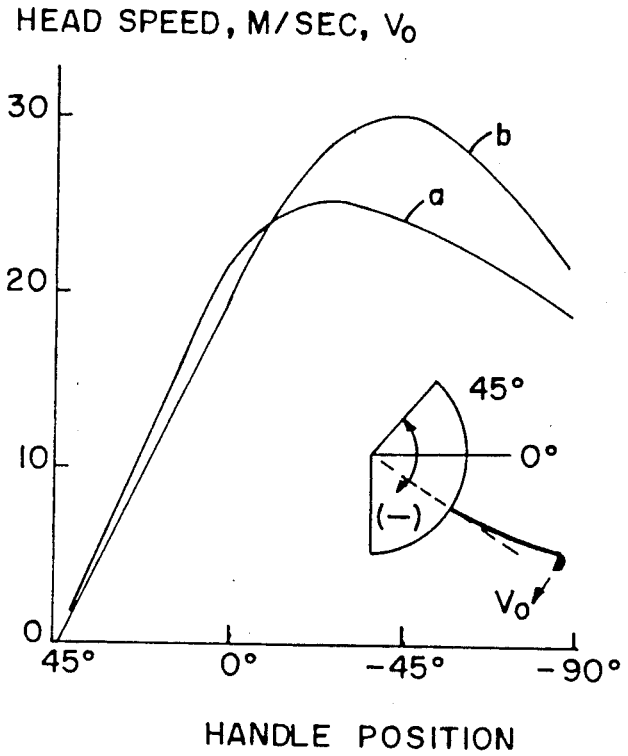
FIG. 11 shows the head speed versus the handle position for the conventional club and the inventive club.

FIG. 11 compares the FIG. 1 club with and without an assembly of 10 cm long. Curve a is without the assembly, as shown in FIG. 10A, and curve b is with the assembly installed, all other factors are equal. The maximum head speed for curve b is 29.4 m/sec. whileas for curve a, as said before, the speed is 26.0 m/sec. The 13% increase in the speed is due to the assembly installed. Based on Eq.(10), the distance of drive of the ball is proportional to the speed of the head squared. The 13% increase in head speed will increase the drive distance of the ball by 27%. The original club will have a drive distance of 275 m. The club with the 10 centimeter assembly installed will have a drive distance, 27% more, to 353 m. We can install another 10 cm assembly within the handle to get further distance if we want, but at the sacrifice of less control of the head during its trajectory. Experience in driving a club with the invention will improve on that.

Figure 12:
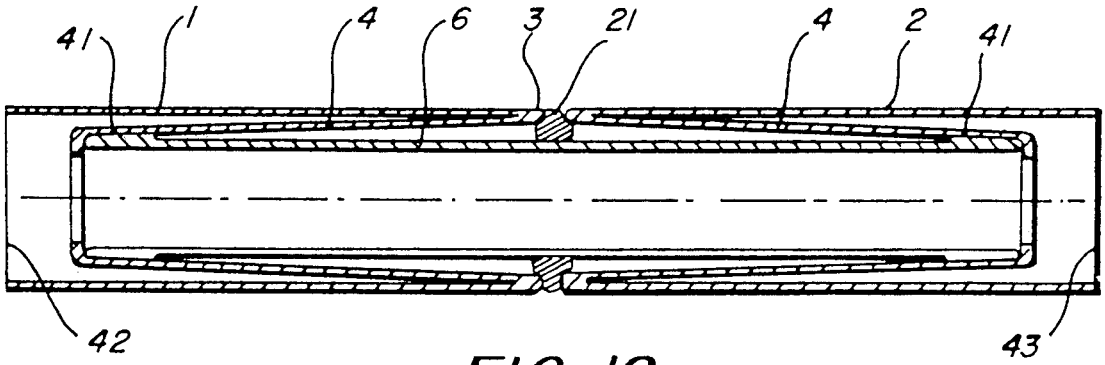
FIG. 12 shows two assemblies coupled through a common central member.

FIG. 12 shows a more preferred embodiment wherein the two assemblies share, or joined together as, a common central member 6, each has its own intermediate tube 4. Coupling of segments with their intermediate tubes may be made by casting or molding integrally or joined by other ordinary attachment means, such as industrial glue or threads at interface 41. Segment 1 and tube 4 in each assembly may be molded integrally, or different. This should presents no problem. Before the two subunits are joined by member 6, a cushion ring 21, or other substance or device, may be inserted in the joint as shown in FIG. 5. It is an option. Such a two-unit, head-to-head assembly is ideal to be used in the handle. End 42 may be the butt end of the rubber grip which extends all the way to cover end 43. There could be more than two assemblies in the handle.

Figure 13:
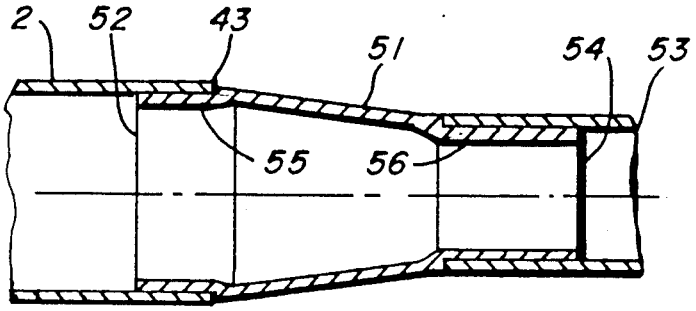
FIG. 13 shows an adaptor.

Such a self-sufficient handle may be offered as a standard equipment. A pro shop may have a large selection of simple tubular adaptors which has one end to be coupled to the standard end 43 and the other end fits a particular golf club. A portion of the existing handle of the club is cut off, polished, and then fitted into the other end of the adaptor by ordinary means, such as glue, screw or thread, etc. and the joint covered by the rubber grip. FIG. 13 shows such an adaptor 51 joins segment 2 at end 52 and the other part of the golf shaft 53 at the other end 54. Interfaces 55 and 56 may be glued or joined tightly by threads. Other ordinary coupling means may be used. End 52 of the adaptor has one size to fit the standard handle 43; size of the other end 54 should have a wide selection to fit different brands of golf club shafts. Pro shops may offer such a service of refitting old clubs to enhance its performance.

It is to be mentioned that a central pre-tensioned wire as described in FIG. 7A may be installed in the assembly described in FIG. 12. Wire end 36 may be anchored at the inside of the adaptor 51 in FIG. 13 with its location 32 anywhere within the length of 52. The other end of the wire may be in segment 1 near the butt end of of the handle, similar in arrangement of FIG. 7A. Wire tension can be adjusted through the opening in the cap near the butt end of the grip. Seat 33 may be movable along the axis. One way to move it is described along with FIG. 7B, but other ways are possible.

Another merit for the invention is that if it is desired that the end displacement (the throw back of the head during the drive) remains the same as the previous club without the assembly, then the shaft with assembly could be made stiffer but having the same range. It is an important advantage. The state of art to improve the drive range of a golf club is to use fiber-reinforced material for the club to make it more flexible in the portion near the head, so that the head can be bent more backward during the drive to enhance the speed during straightening of the shaft. However, when the curvature change is being made mostly in the portion of the shaft closer to the head and less on the portion near the handle, the tail end of the shaft tends to flutter, and the handle has less control of the position of the head which is important in guiding the head to hit the ball squarely at its center. This has been a complaint by golfers who are familiar with metal clubs and are not used to the narrow-necked clubs of recent types. The inventive club can be made stiffer and bent less for the same amount of throwback of the head. This will make the club easy to handle, less fluttering and retaining better control. The impact velocity would still be the same as the conventional club. This is an important advantage.

Figure 14:
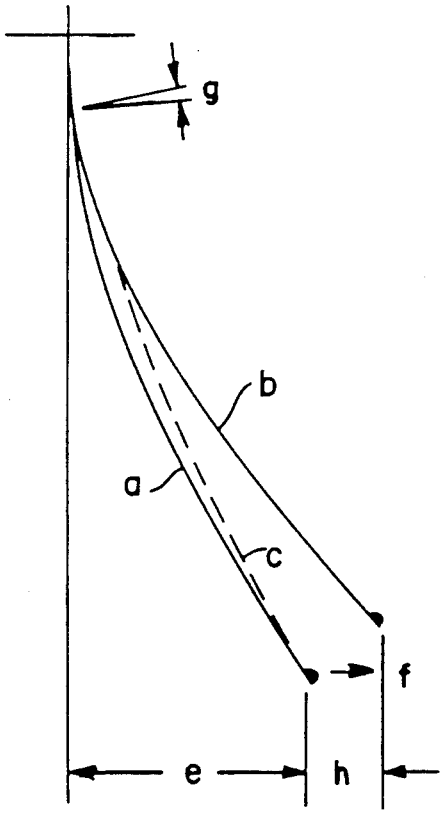
FIG. 14 shows bending curves of shafts.

FIG. 14 shows the results of the dynamic analysis of maximum deflection and the inertia force at the head. Curve a is the computer calculated bending curve of the conventional club of FIG. 1 at its maximum curved shape when the strain energy stored in the club shaft is the maximum and the inertia force from the head is also maximum. The end displacement is 35.1 cm and the inertia head force is 5.7 kg. Curve b is the FIG. 1 shaft having an assembly of length 10 cm (b in Table 1 is of 10 cm, N in Table 1 is 9, becasue the total length of the shaft is $10\times b$, so $N=10-1=9$).) installed at the handle. The additional angle of inclination at the point 3* of FIG. 9 for this curve is 7.3 degrees which is shown in FIG. 14. This is obtained from Table 1: $p_3^*-p_3=2\times p_3=2\times(Fb^2/D)(N+0.5)$, where $F=6.1$ kg, $b=10$ cm, $D=91.367$ kg/cm$^2$, $N=9$. Therefore, $p_3^*-p_3=0.127$ radian$=7.3$ degrees. The additional deflection of the head due to this additional angle at point 3* at the handle is then $0.127\times 90$ cm$=11.4$ cm. This agrees quite well with the more exact computer results of 9.6 cm as shown in FIG. 14. The small discrepancy is due to the linear nature of the estimate from Table 1 whileas the computer result is exact based on the analysis in which the distributed mass of the shaft and the large deflections are taken into consideration. Curve c in FIG. 14 is the FIG. 1 shaft with the taper reduced to make the shaft much more stiff. The assembly is kept at the handle, so that the maximum deflection of the head is reduced to about 35 cm, the same as the FIG. 1 shaft without the assembly. These three curves are plotted from the computer printout and their bent shapes are accurate. It can be seen that curve c has much less bent in the middle and the club will have better control favored by many players. This is an importrant merit from the present invention.

For golf clubs, with shaft diameter $D_o$ not more than 2.5 cm and length L less than 100 cm, a preferred minimum assembly length b is estimated as follows. Since N in Table 1 ($N=L/b$) is a large number compared with one, we drop fractions in the quantities in Table 1 and prepare the following Table 2:

TABLE 2

| (FIG. 9 reference) |
|---|
| Minimum b based on clearance at butt end 7 = $((D/FL)\times \text{Clearance})^{\frac{1}{2}}$ |
| Minimum b based on clearance at insertion point 3 = $((D/F)\times \text{Clearance})^{\frac{1}{2}}$ |
| Min. b based on additional head displacement = $(D/2FL^2)\times \text{Displacement}$ |

The third minimum b yields the smallest value and is not a candidate. The first and the second all depend on the minimum clearance in locations 10 and 11 (FIG. 4) that the design should maintain. To get the minimum design length of the assembly, the stiffness D of the shaft and the CLEARANCE should use the larger estimated values, and the inertia force F the smaller estimated value. For the shaft of FIG. 1, $D=91.367$ kg-cm2, $F=6.1$ kg. $L=100$ cm. The minimum clearance in FIG. 4 at points 10 and 11 is 0.2 cm, the minimum assembly length b is then 5.5 cm. Based on the discussion, a preferred minimum assembly length of golf club application is about 5 cm. At that length, the additional head travel obtained is 7.3 cm based on the third formula in Table 2. Further preferred length is about 9 cm and two assemblies disposed in the handle which is about 20 cm long. Less than the minimum length, benefit is not significant.

For the assembly as shown in FIG. 5 where a pivot device 21 is employed, the compressive stress imposed on the tube near the pivot point due to the bending moment at that cross section would be prohibitively high if the assembly length 8 is short, because this length 8 is the moment arm by which the compressive force at the pivot is developed due to the moment. When the length of the moment arm is zero, the force is infinite. Therefore, if the assembly has a pivot device, the minimum length of b should be 5 cm or higher.

The invention sees its major contribution as in sports equipments in which the assembly is of circular hollow tubing structure and is suitable to be installed into a similar hollow tubing constructions of the host equipment. The length of the assembly, material, dimensions and other physical specifications may be arbitrary, as long as its structural members are elastic and may be deformed to store strain energy as prescribed to promote the kinetic energy of the host equipment. Golf club is seen as the representative of application of the invention. But sports equipments characteriesd by having long stems joining the head to the handle, such as tennis, squash and badminton, whose cross section not necessary circular, can also be benefitted by the invention, as long as the equipment has a preferred length limit and the stiffness improvement which may affect its performance, has to be made within the preferred length of the stem. In this context, the invention assembly may be of any cross sectional shape as long as it can fit into the stem of the host structure. In a broader sense, the said intermediate tube and the longitudinal member do not have to be completely enclosed within said segments 1 and 2 of the original shaft, so long as they transmit bending moment and curvature change from segment 1 to segment 2 and magnify the angular rotation at said locations.

For the assembly which does not need to be axi-symmetric in its physical properties, they may have different bending stiffness in the two principal axes, defined in ususal mechanics, passing through the center of the cross section, making them orthotropic in their physical properties. This can be accomplished by modifying the cross sectional shape and by orthotropicizing the Young's modulus, like manipulating fiber orientation in fiber-reinforced materials. In this respect, we may again look at FIG. 4 and see it as a rectangular tube assembly. Tubes 4 and 6 may have greater height than width so that they bend more easily about one axis than the other Such assembly is preferred to be used with a rectangular host frame which prefers to bend about a particular axis.

Various other modifications that would occur to a skilled workman in the field may be assumed to come within the scope of the following claims.

What is claimed is:

1. A sports equipment having a handle, a head and a shaft connecting the handle and the head, wherein along the length of the shaft there is at least one shaft segment that is at least partially hollow, has an insertion point, and includes an assembly, wherein the assembly comprises:

(a) a central member, at least partially disposed within the hollow portion of the shaft segment through the insertion point of the shaft segment, wherein the central member is connected to the portion of the shaft disposed beyond the insertion point, and there is provided sufficient spacing around at least a portion of the central member disposed within the hollow portion of the shaft segment to allow lateral movement of at least a portion of the central member relative to the shaft segment during bending of the shaft; and (b) wherein the other end of said central member farthest from the insertion point is connected directly to the butt end of the handle.

2. A sports equipment having a handle, a head, and a shaft connecting the handle and the head, wherein along the length of the sports equipment beginning from the butt end of the handle to the head, there is at least one shaft segment that is at least partially hollow, has an insertion point, and comprises an assembly, wherein the assembly comprises:

(a) at least one intermediate tube, which is at least partially hollow, and which is at least partially disposed within the hollow portion of the shaft segment, wherein there is provided sufficient spacing between at least a portion of the intermediate tube and the shaft segment to allow relative lateral movement of at least a portion of the intermediate tube to the shaft segment during bending of the shaft;

(b) a central member, at least partially disposed within the hollow portion of the shaft segment through the insertion point of the shaft segment, wherein the central member is associated with the portion of the sports equipment disposed beyond the insertion point, and there is provided sufficient spacing around at least a portion of the central member disposed within the hollow portion of the shaft segment to allow lateral movement of at least a portion of the central member relative to the shaft segment during bending of the shaft; and the central member to the intermediate tube during bending of the shaft; and (c) central member associating means for associating the central member to the intermediate tube; and (d) intermediate tube associating means for associating the intermediate tube to the shaft segment, which is disposed at a location after the central member associating means in the direction towards the insertion point of the shaft segment.

3. The sports equipment according to claim 2, wherein the central member associating means and the intermediate tube associating means comprising welded joints to make necessary connections between said components.

4. The sports equipment according to claim 2, wherein the central member is hollow, and further comprising:

(e) a wire disposed within the shaft segment and the central member along their longitudinal axes;

(f) first associating means located in the structure connected to the central member after it exits from the assembly to associate the wire to said structure;

(g) second associating means disposed in the hollow portion of the shaft segment for associating the other end of the wire to the shaft segment with pretensioning capability.

5. The sports equipment according to claim 2 further comprising pivoting means for restricting the lateral movement of the central member relative to the shaft segment, but still allowing rotation about the axis perpendicular to the axis of the shaft segment, at a pivot point located about the insertion point of the segment, during bending of the shaft.

6. The sports equipment according to claim 5, wherein said pivoting means includes at least cushion material.

7. The sports equipment according to claim 2, further comprising a cushion material which fills at least a portion of the spacing between the intermediate tube and the shaft segment and between the central member and the intermediate tube.

8. The sports equipment according to claim 2, wherein the insertion point of the shaft segment is closer to the butt end of the handle than the central member associating means is to the butt end of the handle.

9. The sports equipment according to claim 8, wherein when the longitudinal axis of the shaft is bent by impact of an object with the head, the angle of inclination of the shaft segment at the insertion point, measured along the bending direction of the shaft, relative to the axis passing through the butt end of the handle perpendicular to the longitudinal axis of the handle, is less than the angle of inclination of the central member at the insertion point of the shaft segment.

10. The sports equipment according to claim 9, wherein said angle of inclination of the central member at the insertion point is at least about 40% more than the angle of inclination of the shaft segment measured at said insertion point.

11. A golf club according to claim 2, wherein the shaft segment, the intermediate tube and the central member are concentric circular tubes, wherein the length of the central member within the shaft segment, starting from the insertion point of the shaft segment, is at least about 5 cm.

12. The sports equipment according to claim 2, wherein at least one component selected from the group consisting of the shaft segment, the intermediate tube, and the central member, is orthotropic in its bending stiffness with respect to its two principal axes passing through the center of its cross section.

13. The sports equipment according to claim 12, wherein at least one component has a non-circular cross section.

14. The sports equipment according to claim 2, further comprising a second shaft segment which is at least partially hollow, has an inserting end, and comprises an assembly.

15. The sports equipment according to claim 2, further comprising an adjacent second shaft degment which is at least partially hollow, has an insertion point, and comprises an assembly, wherein the central member of the first segment is coupled to the central member of the second segment.

16. The sports equipment according to claim 2, wherein the shaft segment is disposed as close to the butt end of the handle as possible.

17. A detachable golf club handle comprising at least one shaft segment, wherein the segment is at least partially hollow, has an insertion point, and comprises an assembly, wherein the assembly comprises:

(a) at least one intermediate tube, which is at least partially hollow, and which is at least partially disposed within the hollow portion of the shaft segment, wherein there is provided sufficient spacing between at least a portion of the intermediate tube and the shaft segment to allow relative lateral movement of at least a portion of the intermediate tube to the shaft segment;

(b) a central member at least partially disposed within the hollow portion of the intermediate tube through the insertion point of the shaft segement, and there is provided sufficient spacing between at least a portion of the central member and the intemediate tube to allow relative lateral movement of at least a portion of the central member to the intermediate tube; and (c) central member associating means for associating the central member to the intermediate tube; and (d) intermediate tube associating means for associating the intermediate tube to the shaft segment which is disposed at a location after the central member associating means in the direction towards the insertion point of the shaft segment.

18. The detachable handle according to claim 17, further comprising shaft coupling means for coupling the handle to the golf club shaft.

19. The detachable handle according to claim 18, wherein the shaft coupling means comprises an adaptor.

20. The detachable handle according to claim 17, further comprising an adjacent second shaft segment which is at least partially hollow, has an insertion point, and comprises an assembly, wherein the central member of one segment is coupled to the central member of the second shaft segment.

21. The detachable handle according to claim 20, further comprising shaft coupling means for coupling the handle to the golf club shaft.

22. A sports equipment having a handle, a head and a shaft connecting the handle and the head, wherein along the length of the sports equipment beginning from the butt end of the handle to the head there is at least one shaft segment that is at least partially hollow, has an insertion point, and includes as assembly, wherein the assembly comprises:

(a) a central member, at least partially disposed within the hollow portion of the shaft segment through the insertion point of the shaft segment, wherein the central member is associated with the portion of the sports equipment disposed beyond the insertion point, and there is provided sufficient spacing around at least a portion of the central member disposed within the hollow portion of the shaft segment to allow lateral movement of at least a portion of the central member relative to the shaft segment during bending of the shaft; and (b) means for associating the central member to the shaft segment, said means for associating the central member to the shaft segment comprising an at least partially hollow intermediate tube, smaller in size than the segment but at least partially larger than the central member, coupled with the segment at one end close to the insertion point and coupled with the central member at the other end.

23. A sports equipment according to claim 1 wherein said spacing between the central member and the internal surface of the shaft, including the insertion point and said butt end, is at least partially filled with damping material for cushioning effect to reduce vibration and echo of the central member.

24. The sports equipment defined in claim 1 wherein the moment of inertia at the cross-section of the segment, including the assembly, is for at least a portion of its axial length, orthotropic with respect to at least one principal axis passing through the center of gravity at said cross-section.

* * * * *